US009214140B1

(12) United States Patent
Hayden

(10) Patent No.: US 9,214,140 B1
(45) Date of Patent: Dec. 15, 2015

(54) GUITAR TUNING AND STRING ATTACHMENT SYSTEM

(71) Applicant: Robert A Hayden, Deptford, NJ (US)

(72) Inventor: Robert A Hayden, Deptford, NJ (US)

( * ) Notice: Subject to any disclaimer, the term of this patent is extended or adjusted under 35 U.S.C. 154(b) by 17 days.

(21) Appl. No.: 14/331,347

(22) Filed: Jul. 15, 2014

(51) Int. Cl.
*G10D 3/10* (2006.01)
*G10D 3/14* (2006.01)

(52) U.S. Cl.
CPC ..... *G10D 3/14* (2013.01)

(58) Field of Classification Search
CPC ..... G10D 3/14
USPC ..... 84/297 R
See application file for complete search history.

(56) References Cited

U.S. PATENT DOCUMENTS 5,589,653 A * 12/1996 Rose ..... G10D 3/14 84/297 R
2014/0311317 A1* 10/2014 Gray ..... G10D 1/08 84/298

* cited by examiner

*Primary Examiner* — Jianchun Qin
(74) *Attorney, Agent, or Firm* — Stuart M. Goldstein

(57) ABSTRACT

A unique guitar has a head section with a base member connected to a support member. A string tuning unit is configured to be positioned on and be removeably secured to the support member in order to maintain the string tuning unit as part of the head section. The guitar secures strings to its bridge by use of uniquely designed pins, each having a slotted top section with a bottom stem offset from the top section and extending therefrom.

9 Claims, 5 Drawing Sheets

GUITAR TUNING AND STRING ATTACHMENT SYSTEM

FIELD OF THE INVENTION

The herein invention is directed to a unique guitar having a novel means for connecting a string tuning unit and for securing its strings to the bridge of the guitar.

BACKGROUND OF THE INVENTION

A conventional guitar tuning head utilizes string connecting pegs that extend out from the upper surface of the tuning head. The strings run from the pegs to the guitar body where they are wrapped around stems of pins located within the guitar's bridge. It takes well over a dozen turns of the pegs to tighten the string sufficiently to allow the string to be played. As a result, guitars and similar stringed instruments are not only difficult to tune, but they also get out of tune quickly. In addition, since a small movement of the turning pegs makes a substantial change in the pitch, any slippage drastically changes the pitch of the string, requiring additional tuning of the instrument.

To address these limitations and disadvantages, a novel string tuning unit has been developed. Such a unit is described in detail in now abandoned application Ser. No. 08/147,303, filed on Nov. 5, 1993, the disclosure of which is incorporated by reference herein.

However, there is currently no means to readily and efficiently secure a string tuning unit to the neck of an existing or new guitar. Further, the pins which receive and maintain strings on the guitar bridge have been utilized for years and have significant disadvantages. These pins are often difficult to insert in the pin receiving holes within the bridge and the guitar body, and they are difficult to remove if they become damaged or if they need to be replaced. Further, the string to pin connection inherent with most guitar pins is often a difficult and frustrating process.

SUMMARY OF THE INVENTION

It is thus the object of the present invention to provide a unique guitar which addresses the limitations, disadvantages, and problems in connecting string tuning units and strings to a guitar.

It is the object of the present invention to provide a unique guitar comprising a head section which includes a string tuning unit which is readily attachable to and removeable from above the neck of the guitar.

It is a further object of the present invention to provide a unique guitar which utilizes uniquely designed guitar pins which are easily inserted into and removed from the guitar bridge and the guitar body and which allow ready and simple insertion of guitar strings to maintain the strings in place over the guitar bridge.

These and other objects are accomplished by the present invention, a guitar comprising a head section having a base member connected to a support member. A string tuning unit is configured to be positioned on and be removeably secured to the support member in order to maintain the string tuning unit as part of the head section. The guitar secures strings to its bridge by use of uniquely designed pins, each having a slotted top section with a bottom stem offset from the top section and extending therefrom.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
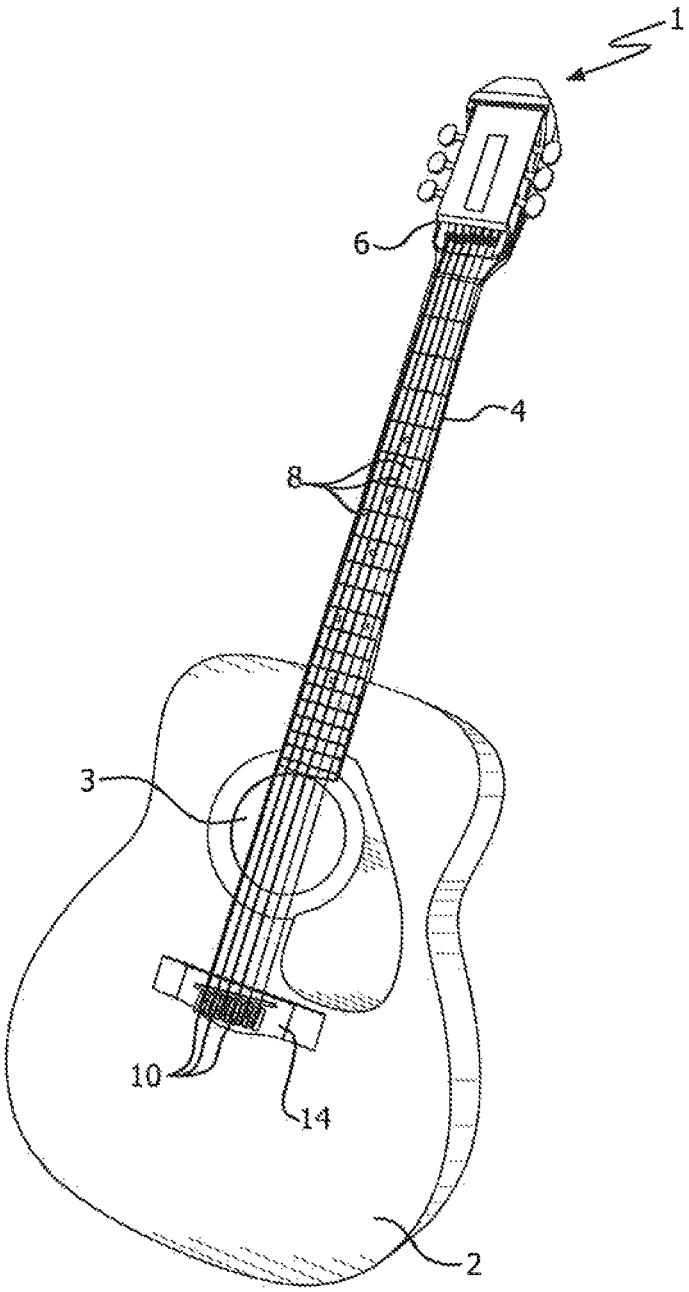
FIG. 1 is a front perspective view of the guitar of the present invention.
Figure 2:
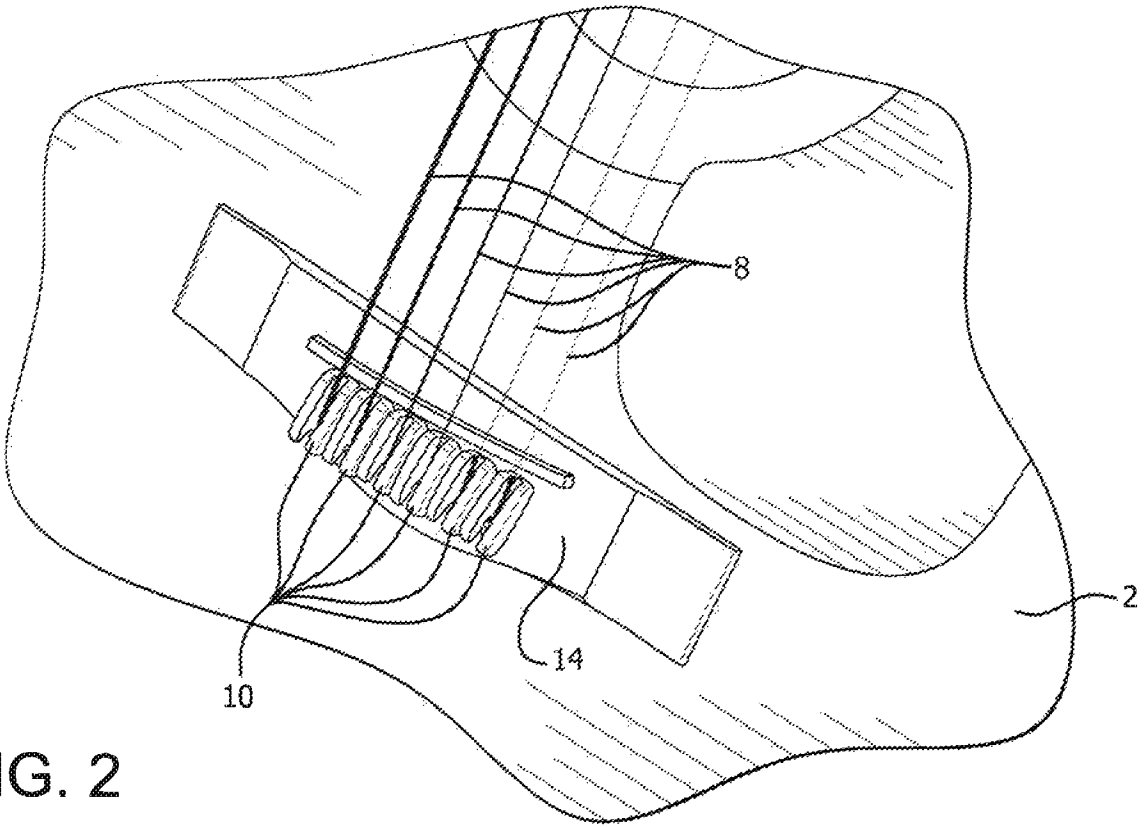
FIG. 2 is a close-up view of the strings connected to the pins of the present invention.

Guitar 1 comprises guitar body 2, neck 4, head section 6, and strings 8. The strings extend from head section 6 to pins 10 of the present invention. Pins 10 extend through pin receiving holes 12 in guitar bridge 14 and also corresponding holes 5 through the top of guitar body 2. See FIG. 8.

Figure 5:
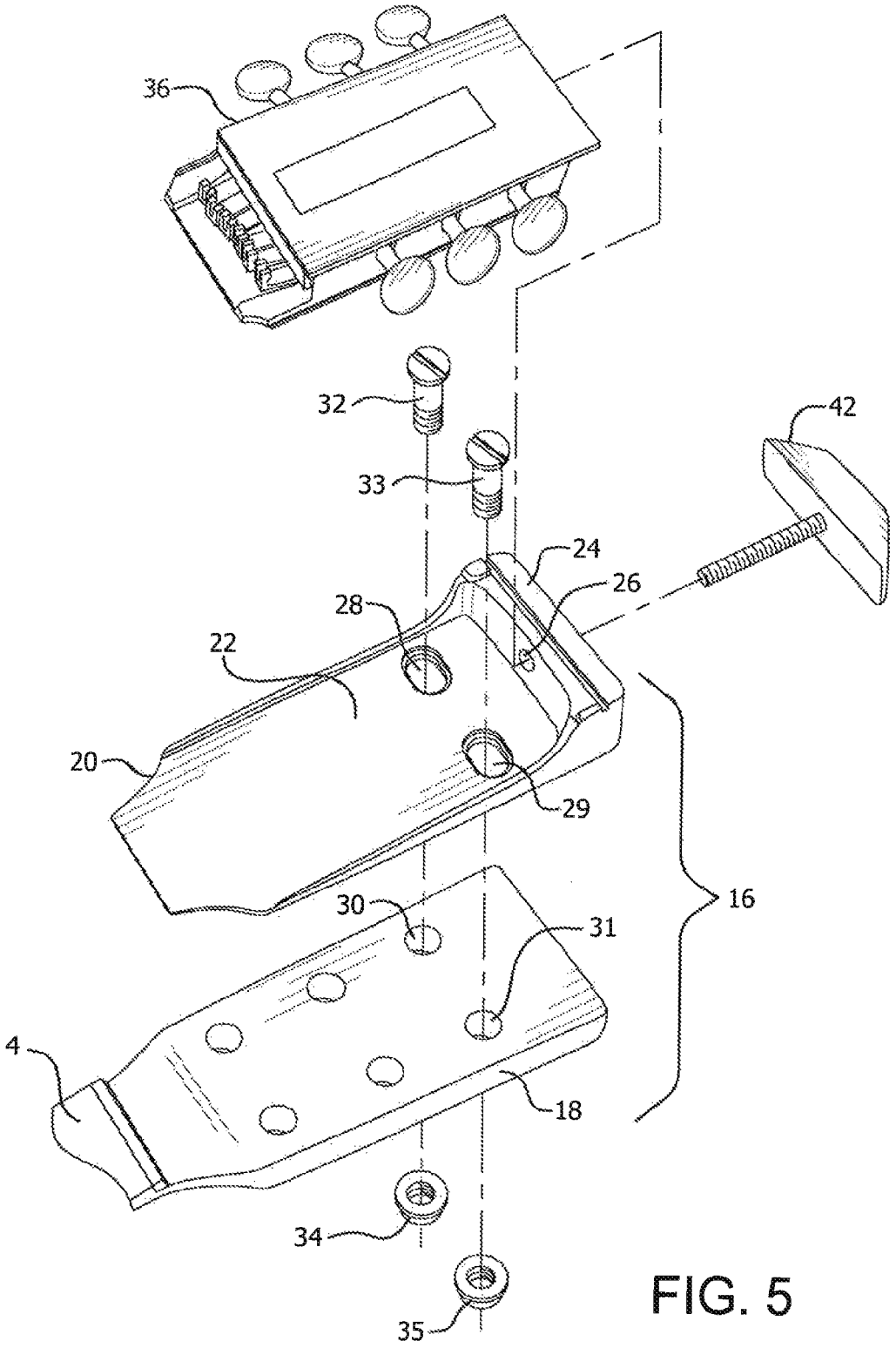
FIG. 5 is an exploded view of the components of the head section of the guitar of the present invention.

As particularly shown in FIG. 5, head section 6 of guitar body 2 comprises lower section 16 having base member 18 integral with and extending from neck 4. Head section 6 also comprises separate support member 20 positioned on the base member. Support member 20 has upper surface 22 and upwardly extending wall member 24 with opening 26 extending therethrough. Openings 28 and 29 extend through support member 20 and are configured to align with openings 30 and 31 through base member 18. Attachment means, in the form of bolts 32 and 33, extend through openings 28, 29, 30 and 31 to connect support member 20 to base member 18, via attaching nuts 34 and 35.

Figure 3:
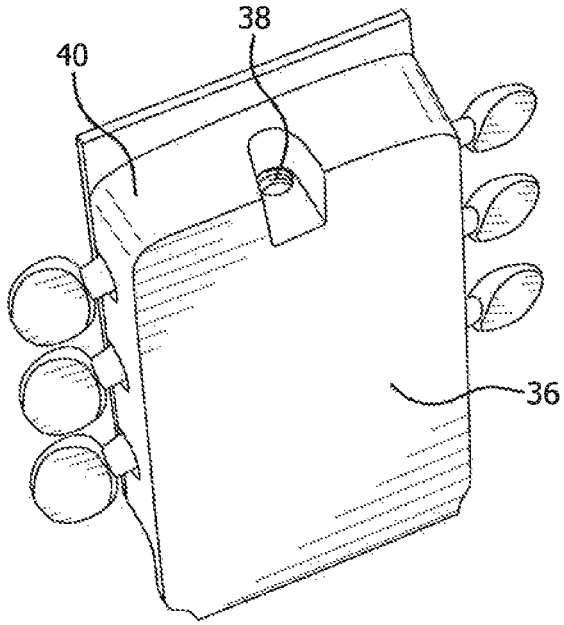
FIG. 3 is a rear perspective view of the string tuning unit, part of the head section of the present invention.
Figure 4:
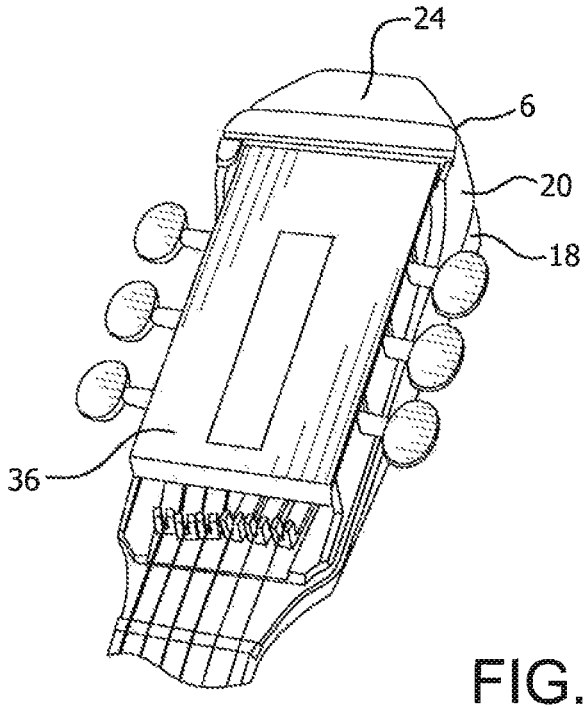
FIG. 4 is a close-up front view of the head section of the guitar of the present invention.

Head section 6 further comprises string tuning unit 36, located on upper surface 22 of support member 20. Threaded opening 38 is located within top end 40 of string tuning unit 36. See FIG. 3. Attachment means in the form of extended arm bolt 42, is positioned within opening 26 of wall member 24 and is threaded into opening 38 of string tuning unit 36 in order to connect the string tuning unit in position on support member 20. In this manner, string tuning unit 36 is removeably secured, not only to support member 20, but also base member 18 and hence to guitar 1.

It is further contemplated that base member 18 and support member 20 of head section 6 could be intricately formed as one component, with an upwardly extending wall member at its top having an opening, positioned similarly to opening 26 in the above described preferred embodiment. String tuning unit 36 would then be positioned on the upper surface of this integral component, just as it is positioned on the upper surface 22 of support member 20, again as described in the preferred embodiment.

Figure 6:
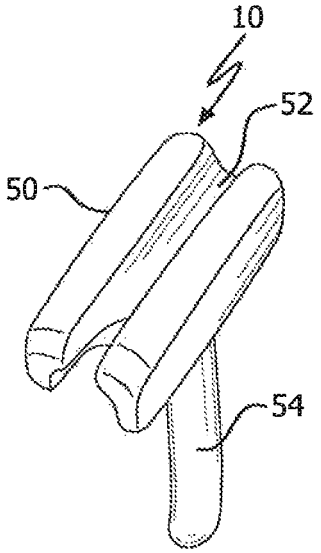
FIG. 6 is a top perspective view of the pin of the present invention.
Figure 7:
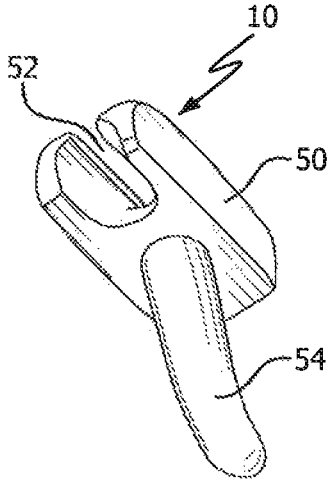
FIG. 7 is a bottom perspective view of the pin of the present invention.
Figure 8:
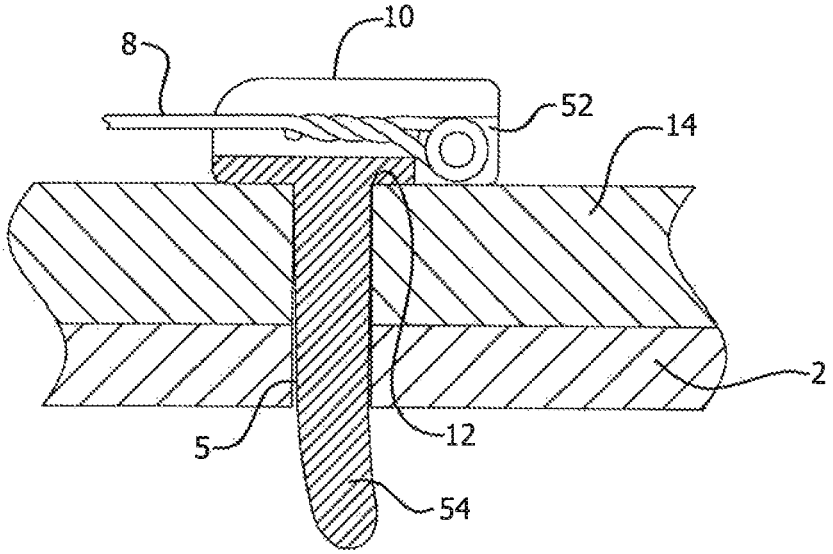
FIG. 8 is a cross-sectional view of the pin of the present invention inserted into the bridge and body of the guitar.

Strings 8 extend over neck 4 to guitar body 2 of guitar 1 and are removeably secured to bridge 14 by pins 10 of the present invention. These pins, as seen in detail in FIGS. 6-8, each comprise top section 50 having slot 52 which extends substantially the length of the top section. Stem 54 extends from and is substantially perpendicular to top section 50 and is offset from the mid-point of the top section. Stem 54 is also curved, as seen in FIG. 8, so as to fit and be maintained within pin receiving holes 12 of bridge 14 and 5 of guitar body 2.

When inserted into pin receiving holes 5 and 12, pins 10 allow strings 8 to be easily and simply laid into their slots 52, to maintain the strings in place on bridge 14. Strings 8 can also be easily lifted out of slots 52 when the strings need to be replaced.

The curved configuration of stems 54 of pins 10 permits the pins to be easily inserted and pushed into pin receiving holes 12 in bridge 14 and corresponding holes 5 in guitar body 2. Pins 10 can also be easily removed from guitar body 2 simply by the insertion of one's hand into sound hole 3 of the guitar body and pushing up on the bottom of stem 54, thus popping the pin out of pin receiving holes 5 and 12.

Thus, the present invention provides a unique guitar having novel means to secure, maintain, and easily remove a string tuning unit on the head of a guitar and a novel guitar pin easily insertable into and removed from a guitar body, which simply and easily allows guitar strings to be positioned, maintained, and removed from a guitar bridge.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A guitar having a body, a neck, a head section, and guitar strings extending from the head section to the body, the head section comprising:

a lower section having an upper surface and an upwardly extending wall member, the lower section comprising a base member integral with and extending from the neck and a separate support member positioned on the base member, said upper surface of the lower section being located on the wall member, the wall member extending up from the support member and having an opening extending therethrough;

a string tuning unit located on the upper surface of the lower section of the head section, said string tuning unit comprising a top end and a threaded opening extending into the top end; and first attachment means extending through the opening in the wall member of the lower section and the threaded opening in the string tuning unit for connecting the string tuning unit to the lower section of the head section.

2. The guitar as in claim 1 wherein the string turning unit is located on the support member and the first attachment means connects the string tuning unit to the support member.

3. The guitar as in claim 1 wherein the base member and support member each comprise at least one through opening, and second attachment means extending through the base member and support member openings to connect the base member to the support member.

4. The guitar as in claim 3 wherein the string tuning unit is located on the support member and the first attachment means connects the string tuning unit to the support member.

5. A guitar having a body, a neck, a head section, a bridge on the body having pin receiving holes, string retaining pins located in the pin receiving holes, and guitar strings extending from the head section to the string retaining pins;

the head section comprising:

a lower section having an upper surface and an upwardly extending wall member, the lower section comprising a base member integral with and extending from the neck and a separate support member positioned on the base member, said upper surface of the lower section being located on the support member, the wall member extending up from the support member and having an opening extending therethrough;

a string tuning unit located on the upper surface of the lower section of the head section, said string tuning unit comprising a top end and a threaded opening extending into the top end; and first attachment means extending through the opening in the wall member of the lower section and the threaded opening in the string tuning unit for connecting the string tuning unit to the lower section of the head section;

each said string retaining pin comprising:

a top section having a slot extending the length of the top section; and a stem section extending from and substantially perpendicular to the top section, said stem section being positioned within a pin receiving hole of the bridge, whereby a string is laid within the slot of the pin to removeably secure and maintain the string within the bridge.

6. The guitar as in claim 5 wherein the string tuning unit is located on the support member and the first attachment means connects the string tuning unit to the support member.

7. The guitar as in claim 5 wherein the base member and support member each comprise at least one through opening, and second attachment means extending through the base member and support member openings to connect the base member to the support member.

8. The guitar as in claim 7 wherein the string tuning unit is located on the support member and the first attachment means connects the string tuning unit to the support member.

9. The guitar as in claim 5 wherein the stem of each pin is curved so as to fit and be retained within the pin receiving hole of the bridge.

* * * * *